US005105707A

United States Patent [19]

Fujii

[11] Patent Number: 5,105,707

[45] Date of Patent: Apr. 21, 1992

[54] METHOD OF AND DEVICE FOR AUTOMATICALLY AND INSTANTANEOUSLY SHIFTING A MUSICAL SCALE OF A PIANO TO ANOTHER MUSICAL SCALE

[76] Inventor: Kaneharu Fujii, 424-31, Oowadashinden, Yachiyo-shi, Chiba, 276, Japan

[21] Appl. No.: 530,964

[22] Filed: May 25, 1990

[51] Int. Cl.[5] ..... G10G 7/02

[52] U.S. Cl. ..... 84/454; 84/DIG. 18

[58] Field of Search ..... 84/445, 448, 454, 455, 84/200, DIG. 18

[56] References Cited

U.S. PATENT DOCUMENTS 4,584,923 4/1986 Minnick ..... 84/454

FOREIGN PATENT DOCUMENTS 2587530 3/1987 France ..... 84/454

*Primary Examiner*—L. T. Hix
*Assistant Examiner*—Howard B. Blankenship
*Attorney, Agent, or Firm*—Wenderoth, Lind & Ponack

[57] ABSTRACT

A method of automatically and instantaneously shifting the musical scale of a piano is constituted by the steps of gradually changing the tension of the strings or the length of a vibrating portion of strings of the piano for changing the tone of the tension adjusted or vibration length adjusted strings in order to shift the musical scale of the piano to another desired musical scale, simultaneously applying mechanical vibrations to the respective strings at the same frequency as the frequency of the tones required for the respective strings to obtain the desired musical scale, detecting the resonance of the respective strings, and when resonance of the respective strings is detected, discontinuing the change of tension or change of length of the vibrating portion of the strings and application of the mechanical vibrations.

6 Claims, 2 Drawing Sheets

METHOD OF AND DEVICE FOR AUTOMATICALLY AND INSTANTANEOUSLY SHIFTING A MUSICAL SCALE OF A PIANO TO ANOTHER MUSICAL SCALE

BACKGROUND OF THE INVENTION

1. Field of the Invention

This invention is provided in order to expand the performance of a piano by automatically and instantaneously shifting the musical scale of a piano to another musical scale.

2. Description of the Prior Art

A piano is tuned to an even temperament musical scale. However, music in the world is often tuned in an individual musical scale obtained by making and originating a natural represented tone as a fundamental and such fundamental tone has been selected differently at different times and by racial and regional characteristics (hereinafter referred to as a natural represented tone type musical scale). This music cannot be reproduced vividly unless the respective musical scale is used.

In these types of musical scales, if the fundamental note of the musical scale changes, the intervals between the notes of the musical scale will change so that the variety of tones is increased, and in the case of a piano, the number of keys must be increased. As a result, if a piano remains unchanged, then it cannot be put to practical use for such music by reason of the mechanism and playing technique.

An even temperament has been devised artificially in order to prevent the above-described difficulties. But an even temperament has such insufficiencies that the beauty of tones, particularly at the point of chords, is inferior in comparison with a natural represented tone. These insufficiencies are recognized in acoustics in both physics and music.

SUMMARY OF THE INVENTION

As described above, in order to represent a natural type musical scale, it is necessary for a piano to have several times the number of kinds of tones an existing piano has, but it is necessary to provide a piano which can be used with a conventional playing technique and which has the same number of keys as a conventional piano.

A most appropriate means to solve the problem is to make it possible for each string to produce several different tones.

As a simple method of putting such means into practice, the present invention provides a method wherein the tension of a particular string or the length of the vibrating portion of a string is adjusted so as to produce several tones from a single string to cope with requirements of various musical scales.

In order to attain the object of changing the tension of a predetermined string to a tension of such string which is suitable to produce a required tone, or to attain the object of changing the length of a vibrating portion of the string to a length of string suitable to produce a particular tone in order for the predetermined string to produce a particular tone, the tension of the string is adjusted while transmitting mechanical vibrations having the same frequency as that of the particular tone to the string, or the length of the vibrating portion of the particular string is adjusted while transmitting mechanical vibrations having the same frequency as that of the particular tone to the string, so that the string will resonate due to the relationship between them, and when a sudden change in amplitude is caused by such resonance, the operation of adjusting the tension of the string or of adjusting the length of the vibrating portion of the string is stopped, while at the same time the operation of transmitting mechanical vibrations having the same frequency as that of the particular tone to the string is stopped.

In particular, the present invention provides a method of automatically and instantaneously shifting a musical scale of a piano, which is characterized in that in changing the tone of each string in order to shift the musical scale of the piano to any other musical scale, the tension of the string or the length of a vibrating portion of the string is adjusted while transmitting mechanical vibrations having the same frequency as the frequency of a particular tone to the string, and a resonance phenomenon of the string which occurs due to the relationship between them is utilized.

Meanwhile, the present invention provides another method of automatically and instantaneously shifting a musical scale of a piano wherein in changing a tone of each string in order to shift the musical scale of the piano to any other musical scale, the tension of the string or the length of the vibrating portion of the string is adjusted while transmitting mechanical vibrations having the same frequency as the frequency of a particular tone to the string, and a sudden increase in amplitude which is caused by a resonance phenomenon of the string which occurs due to a relationship between them is detected by means of an optical sensor, and when the optical sensor detects a sudden increase in amplitude, the adjustment of the tension or of the length of the vibrating portion of the string is stopped immediately.

Further, the present invention provides a device for automatically and instantaneously shifting the musical scale of a piano, which comprises a string tension adjusting means for adjusting the tension of each string of the piano or a string vibrating portion length adjusting means for adjusting the length of a vibrating portion of the string, an oscillator for applying mechanical vibrations having the same frequency as the frequency of a particular tone to the string, an optical sensor for detecting a sudden increase of the amplitude of the string, and a controlling means for controlling the string tension adjusting means or the string vibrating portion length adjusting means.

In the device of the present invention, patterns of required musical scales are stored in a storage device of a computer, and the various components operate in response to instructions from the outside.

In particular, the oscillator applies mechanical vibrations having the same frequency as the frequency of a required tone to a bridge of each required string to compulsorily vibrate the string while, in the case of the string tension adjusting means, the tension of the string is adjusted, but in the case of the string vibrating portion length adjusting means, the length of the vibrating portion of the string is adjusted. The optical sensor is placed adjacent a central portion of the string, and a light emitting element of the optical sensor irradiates the string with light peculiar thereto while a detecting element receives the light and waits an abnormal amplitude of the string. During the course of the adjustment of the tension the string receives, or during the course of the adjustment of the length of the string vibrating portion, a resonance phenomenon occurs and the amplitude increases suddenly at a point of time at which the tension of the same value as the string tension when the required tone is produced as a fundamental vibration is reached, or at a point of time when the string vibrating portion length of the same value as the string vibrating portion length when the required tone is produced as a fundamental vibration is reached. Such increase of the amplitude is read by the optical sensor, and the circuit is interrupted and the tone to be produced from the string for producing a predetermined tone can be changed to the required tone.

According to the present invention, various musical scales can be obtained simply in this manner, and since appearance and representation particularly of a natural represented tone type musical scale as well as modulation can be obtained readily, accurately and instantaneously while the musical performance is proceeding, a desirable reformation of the performance of a piano can be attained.

DESCRIPTION OF THE PREFERRED EMBODIMENTS

Embodiment 1

Figure 1:
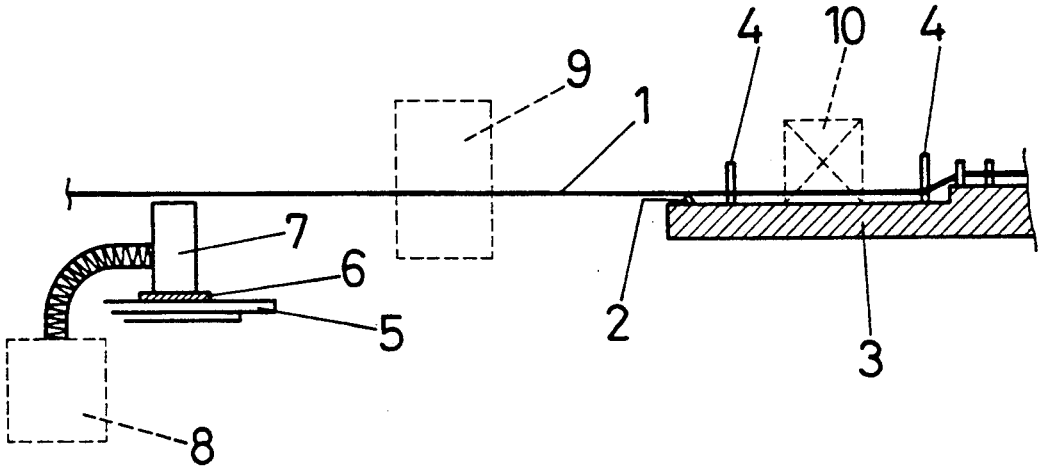
FIG. 1 is a front elevational view of a musical tone producing device showing an embodiment of the present invention.
Figure 2:
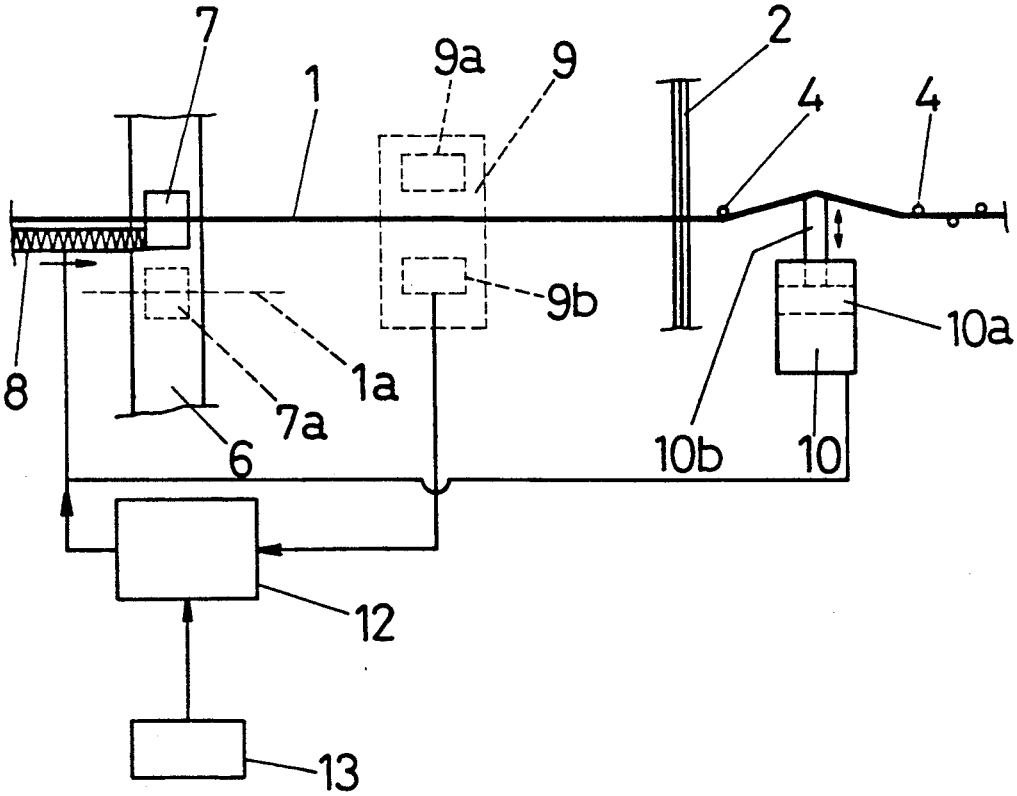
FIG. 2 is a plan view of the device shown in FIG. 1.

A device according to the embodiment by which a natural represented tone type musical scale described hereinabove is obtained will be described with reference to FIGS. 1 and 2 of the accompanying drawings.

A vibrating portion of a string 1 or l*a* of a piano extends from a bridge 7 or 7*a* to an upper bridge 2, and a string tension adjusting device 10 is provided between the upper bridge and a terminal portion of the string and is operable that it applies or removes a lateral force to or from a portion of the string between two support post pins 4 adjacent the string to adjust the tension of the string. While the string tension is thus disclosed as being adjusted by applying or removing a lateral force in the present embodiment, the method of adjusting the string tension is not limited to this specific adjusting method.

In the device shown, the string tension adjusting device 10 is constituted by a hydraulic cylinder 10*a* and a piston 10*b*.

The device is mounted securely on an iron body frame 3 of the piano.

An oscillator 8 (only the position of the circuit thereof is shown) which is controlled by a CPU 12 (central processing unit) which will be hereinafter described transmits required vibrations to the bridge 7 and the bridge is placed in a closely contacting relationship on a common plate 6 adhered to sound plates 5 independently of the bridges for other individual strings and thus transmits the vibrations to the string.

An optical sensor 9 (only the position of the circuit thereof is shown) is provided adjacent a central portion of the string, and peculiar light radiated from a light emitting element 9*a* of the optical sensor 9 is irradiated upon the string so that a sudden increase of the amplitude which arises from resonance of the string can be detected by a detecting element 9*b* which senses the same. Thus, the operation of the string tension adjusting device 10 and the oscillator 8 can be interrupted, and the adjustment is completed.

It is to be noted that the interruption proceeds when a signal from the detecting element 9*b* is transmitted to the CPU 12 of a computer serving as a controlling means and operation of the string tension adjusting device and operation of the oscillator 8 is stopped at the same time under control of the CPU.

The identification of a required musical scale is inputted to the CPU 12 by way of a switch 13 provided in the area of the keyboard.

The computer communicates to the strings required to be varied the required tones for the respective oscillators 8 and the operation of the individual tension adjusting devices. The individual oscillators and tension adjusting devices operate in accordance with the communicated information, and replacement of the musical scale is completed by the reaction of the optical sensor.

Embodiment 2

The second embodiment is constituted such that the musical scale of a piano is shifted to another required scale not by adjusting the tension of each string as described in the first embodiment, but by moving a bridge to adjust the length of the vibrating portion of each string so as to obtain a resonance phenomenon.

Figure 3:
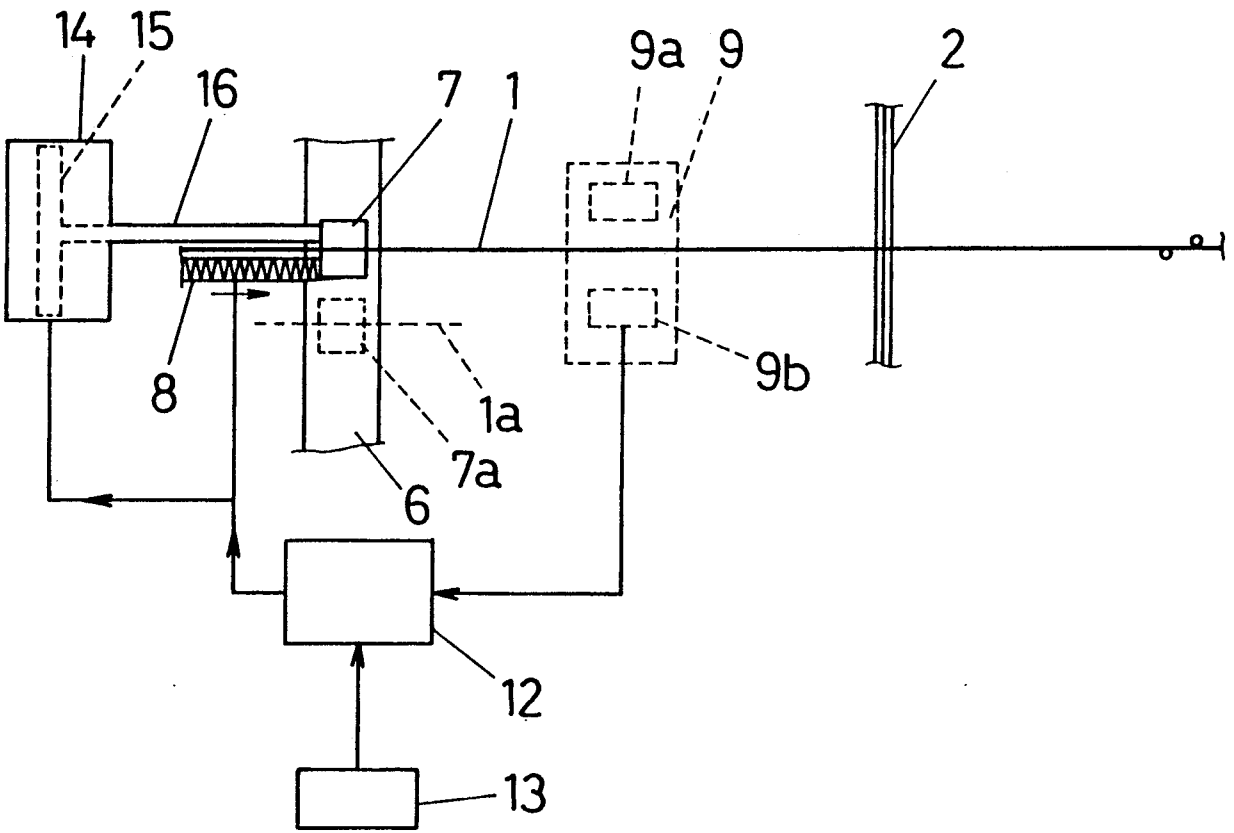
FIG. 3 is a plan view of a different device showing another embodiment of the present invention.

In the case of the second embodiment, a bridge moving adjusting device 14 is disposed behind each bridge 7 as shown in FIG. 3. Similarly, as in the first embodiment, required vibrations transmitted from an oscillator 8 to the bridge 7 are transmitted to the string while a rod 16 similarly mounted on the bridge 7 is operated by a piston 15 so that the bridge 7 is slidably moved on a common plate 7 to adjust the length of the vibrating portion of the string. Then, when the length of the vibrating portion of the string comes into coincidence with a length at which it resonates with a required vibration, resonance occurs and the amplitude increases suddenly.

Such sudden increase in amplitude is read by a detecting element 9 similarly as in the first embodiment, and the cylinder operating means is interrupted, thereby completing the adjustment.

I claim:

1. A method of automatically and instantaneously shifting the musical scale of a piano, comprising:

gradually changing the tension of strings of the piano for changing the tone of the tension adjusted strings in order to shift the musical scale of the piano to another desired musical scale;

simultaneously applying mechanical vibrations to the respective strings at the same frequency as the frequency of tones required for the respective strings to obtain the desired musical scale;

detecting the resonance of the respective strings; and when resonance of the respective strings is detected, discontinuing the change of tension and application of the mechanical vibrations.

2. A method as claimed in claim 1 in which the steps of detecting the resonance of the respective strings and discontinuing the change of tension of the respective strings comprises the steps of detecting a sudden increase in amplitude of the respective strings caused by resonant vibration of the strings by means of an optical sensor, and stopping the changing of the tension in response to the detection by said optical sensor.

3. A method of automatically and instantaneously shifting the musical scale of a piano, comprising:

gradually changing the length of a vibrating portion of strings of the piano for changing the tone of the vibration length adjusted strings in order to shift the musical scale of the piano to another desired musical scale;

simultaneously applying mechanical vibrations to the respective strings at the same frequency as the frequency of the tones required for the respective strings to obtain the desired musical scale;

detecting the resonance of the respective strings; and when resonance of the respective strings is detected, discontinuing the change of length of the vibrating portions and application of the mechanical vibrations.

4. A method as claimed in claim 3 in which the steps of detecting the resonance of the respective strings and discontinuing the change of length of the vibrating portions of the respective strings comprises the steps of detecting a sudden increase in amplitude of the respective strings caused by resonant vibration of the strings by means of an optical sensor, and stopping the changing of the length of the vibrating portions in response to the detection by said optical sensor.

5. A device for automatically and instantaneously shifting the musical scale of a piano, comprising:

a string tension adjusting means for gradually changing the tension of strings of a piano;

an oscillator for applying mechanical vibrations to the respective tension adjusted strings having the same frequency as the frequency of a tone required for the respective strings to obtain the desired musical scale;

an optical sensor for detecting a sudden increase of the amplitude of vibration of the respective strings; and a control means to which said optical sensor is connected and which is in turn connected to said tension adjusting means for controlling said tension adjusting means to stop the changing of tension of the respective strings upon detection by said optical sensor of a sudden increase in amplitude of the respective strings.

6. A device for automatically and instantaneously shifting the musical scale of a piano, comprising:

a string vibrating length adjusting means for gradually adjusting the length of the vibrating portion of strings of a piano;

an oscillator for applying mechanical vibrations to the respective vibrating portion length adjusted strings having the same frequency as the frequency of a tone required for the respective strings to obtain the desired musical scale;

an optical sensor for detecting a sudden increase of the amplitude of vibration of the respective strings; and a control means to which said optical sensor is connected and which is in turn connected to said vibrating portion length adjusting means for controlling said vibrating portion length adjusting means to stop the changing of the length of the vibrating portion of the respective strings upon detection by said optical sensor of a sudden increase in amplitude of the respective strings.

* * * * *